United States Patent [19]

Carroll

[11] Patent Number: 4,993,074

[45] Date of Patent: Feb. 12, 1991

[54] EARPHONE SPACER

[76] Inventor: Robert J. Carroll, 107 Highland Ave., Winchester, Mass. 01890

[21] Appl. No.: 295,493

[22] Filed: Jan. 11, 1989

Related U.S. Application Data

[63] Continuation-in-part of Ser. No. 181,397, Apr. 13, 1988, abandoned.

[51] Int. Cl.[5] ..... H04R 1/28

[52] U.S. Cl. ..... 381/187; 381/189; 381/205; 181/129

[58] Field of Search ..... 381/187, 183, 205; 379/430; 181/129

[56] References Cited

U.S. PATENT DOCUMENTS

| | | | |
|---|---|---|---|
| 1,747,778 | 2/1930 | Küchenmeister | 381/183 |
| 3,488,457 | 1/1970 | Lahti | 381/183 |
| 3,751,608 | 8/1973 | Weingartner | 381/187 |
| 4,302,635 | 11/1981 | Jacobsen et al. | 381/183 |
| 4,523,661 | 6/1985 | Scalzo et al. | 381/187 |
| 4,529,057 | 7/1985 | Telford | 381/187 |
| 4,572,324 | 2/1986 | Fidi et al. | 381/187 |

FOREIGN PATENT DOCUMENTS

| | | | |
|---|---|---|---|
| 2353708 | 5/1975 | Fed. Rep. of Germany | 381/183 |
| 2451427 | 5/1975 | Fed. Rep. of Germany | 381/183 |
| 53-41219 | 4/1978 | Japan | 381/183 |
| 53-88718 | 8/1978 | Japan | 381/183 |

*Primary Examiner*—James L. Dwyer

*Attorney, Agent, or Firm*—John M. Brandt

[57] ABSTRACT

A spacing device which holds earphones away from the ears to create a sense of live music when the earphones are used in conjunction with loudspeakers. The spacers allow sound from loudspeakers set away from the user to reach the ear from all directions. When the spacer is worn to hold earphones a distance from the ear while listening to recorded music played through both earphones and loudspeakers from the same source the user experiences an increase in ambience or sense of concert-hall realism.

6 Claims, 1 Drawing Sheet

EARPHONE SPACER

This application is a continuation-in-part of U.S. patent application Ser. No. 07/181,397 filed Apr. 13, 1988 now abandoned by the same inventor.

BACKGROUND OF THE INVENTION

1. Field of the Invention:

The invention relates to devices for enchancing the quality and realism of electronically reproduced sound. In particular, it relates to a device which allows sound from both earphones and speakers powered by the same source to be heard simultaneously.

2. Description of the Prior Art:

Various electronic sound delay/sound attenuation systems have been used to increase the sense of realism when playing back music via loudspeakers. These systems take musical signals from a primary amplifier and feed them to a computer or other type of processor which in turn feeds the signals to a secondary amplifier and secondary set of speakers. While the primary amplifier drives speakers placed in front of the listeners, the electronic delay system feeds information to the secondary amplifier which drives speakers placed behind the listeners. The more sophisticated systems delay and attenuate frequency separately and randomly for each channel. Users can alter the delay time to simulate ambience that would be present in rooms of varying size.

These electronic sound delay systems are expensive, some of them display limited results, and to date have not become a popular part of the average listeners' stereo system. However, similar and perhaps superior increases in ambience or presence (that is, the sense of being at a "live" concert) can be created, by use of the present invention, without specialized electronic delay systems. By using the standard listener distance of six to eight feet or more for stereo sound away from loudspeakers and by simultaneously listening to earphones that are held just off the ears by the invention and that are connected to the same amplifier that is driving the loudspeakers, a dramatic increase in depth and ambience of sound will be experienced.

The prior art includes structures for holding earphones at a distance from the ear, but they differ substantially from the invention disclosed herein. Lahti U.S. Pat. No. 3,488,457, describes a device which allows the user to change the relative lateral displacement of the sound energy emitting aperture as it relates to the ear canal. However, this device is not designed to allow sound from an outside source to reach the ear unimpeded, and this device is not designed to allow a change in the earphone speaker's distance from the ear.

Jacobson U.S. Pat. No. 4,302,635, discloses an earphone with a pair of cushions that snap onto the sound transducer element, but these cushions are designed as a part of the earphone and relate to comfort rather than acoustic distance from the ear. This system is not designed to let sound from an outside source reach the ear.

Telford U.S. Pat. No. 4,529,057, discloses an ear protector or defender which does allow some sound from sources outside the earphone via a port that can be opened or closed. However, the device is not designed to allow the user to hear outside sound freely, unimpeded, and from front and back, up and down directions simultaneously.

Scalzo et al. U.S. Pat. No. 4,523,661, reveals a sound attenuating earcup assembly that holds the earphone's speakers away from the ear, but the stated purpose is to isolate the ear of a wearer from ambient sound while allowing the user to hear enough for external communication. The earcup assembly is not designed to provide free access of external sound waves from as many directions as possible.

Fidi et al. U.S. Pat. No. 4,572,324, discloses an earphone with a sound impermeable cushion that rests on the head plus a sound permeable section that spaces the earphone's speaker away from the ear. According to the patent, the type of sound permeable section suggested allows an earphone speaker to deliver a full frequency range of 20 Hz to 2 Khz to the ear because it sets up a defined acoustic impedance. The other object of the specified sound permeable layer is to increase comfort by allowing ventilation. Unlike the invention proposed herein, there is no mention of the permeable layer being designed specifically to allow maximum sound to the ear from sources outside the earphone, and there is no mention of using the earphone spacers to hold the earphone's speaker within a critical distance from the ear in respect to outside sound sources Finally, these earphone cushions are designed to be a part of the earphone unit rather than be separate from and used with any earphone, unlike the preferred embodiment of the invention proposed herein.

SUMMARY OF THE INVENTION

The invention may be summarized as an earphone spacer, the purpose of which is to hold each side of a pair of earphones a certain distance from the ears in order to allow both the sound emanating from the phones and that from the speakers within the listening room to reach the ear unimpeded. The spacers are preferably cylindrical in nature, have a base which contacts the ear or the head surrounding the ear and an earphone support spaced apart from the base by means which will allow unimpeded entrance of outside sound, which comprise, for example, stand offs or a perforated tube.

Means may be included to vary the distance between the earphone support and the base. For instance, a plurality of similar units may be stacked and held together by mating interlocking structures or snaps or alternatively co-axial overlapping tubes which are threaded and screw in and out may be employed Means are included to hold the spacers in position on the head by for example a head band or similar device.

The invention thus avoids expensive electronic ambiencegenerating amplifiers, delay systems, and computers and it eliminates the need for back-up amplifiers and speakers and instead relies on the simple expedient of positioning earphones to create concert-hall realism In using this invention, one need only hook earphones up to the same amplifier used to power loudspeakers and play both the loudspeakers and the earphones simultaneously. The invention is then employed to space the earphones a slight distance, approximately one-half to one inch, away from the ear to experience the effect of increased presence.

The various features and advantages of the invention will be more fully understood from the description of the preferred embodiment and drawings which follow.

DESCRIPTION OF THE PREFERRED EMBODIMENT

Figure 1:
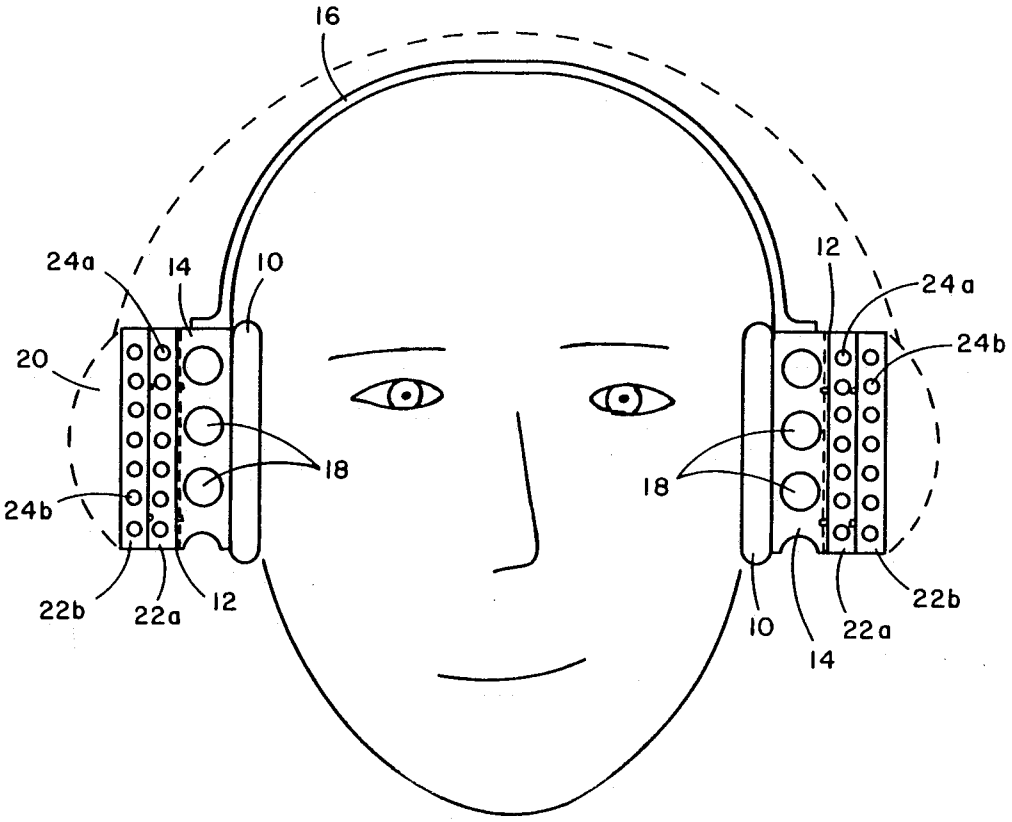
FIG. 1 is an elevational view of the preferred embodiment of the invention.

Referring to FIG. 1, there is shown an elevational view of the preferred embodiment of the invention consisting of a pair of spacers each of which is composed of a base 10, an earphone support 12 and spacing means 14 for separating the base and support.

As illustrated, the spacers are cylindrical and may be fabricated as integral units of, for example, plastic in which the base 10 and support 12 are molded extensions of spacing means 14. Base 10 may be composed of or surrounded by a soft pliable material to provide a cushion to insure the comfort of the user. Headband 16 links the spacers together and provides the means to hold base 10 in contact with the ears or the head surrounding the ears. The headband may be attached to the spacers any convenient way and is shown joined to spacing means 14.

Spacing means 14 is perforated with a plurality of large ports 18, the purpose of which is to allow the unimpeded transmission of external sound to the ear in accordance with the object of the invention to simultaneously subject the user to both loudspeaker and earphone generated sound. The ports occupy the greater portion of the area of spacer 14 and the greater the better as long as structural integrity is maintained.

Figure 2:
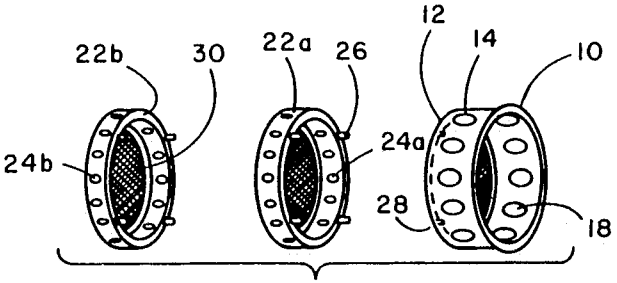
FIG. 2 is a an exploded perspective view of the device of FIG. 1.
Figure 3:
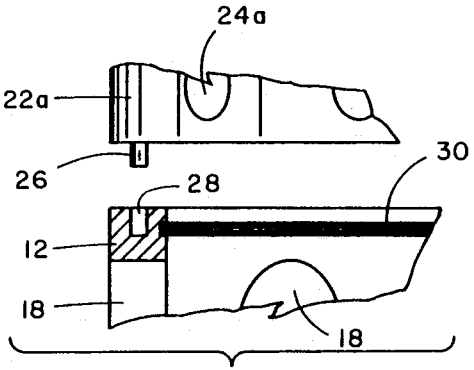
FIG. 3 is a partial cross-sectional view of a portion of the device of FIG. 1

As was heretofore discussed, the user can adjust his or her impression of accoustical ambience and depth of sound by changing the distance of the earphones 20, as shown schematically, from the ear. To this end, additional spacers 22*a* ports 24*a* and 24*b* may be added in back of earphone support 12 and as shown more clearly in FIGS. 2 and 3 can be secured in place by detachable holding means such as posts 26 and receptacles 28 forming a snap-together pull-apart structure.

Finally in order to accomodate earphones of varying sizes smaller than the outer diameter of support 12, a screen 30 may be attached to support 12 to prevent the phones from falling inside the spacer and similar screens would be attached to the openings facing the earphones on spacers 22*a* and 22*b*.

Figure 4:
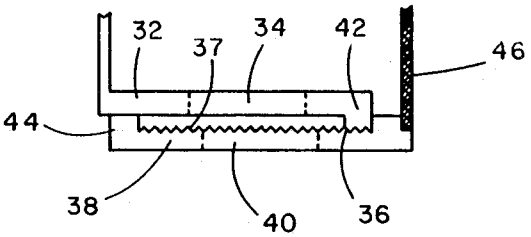
FIG. 4 is a cross-sectional view of an alternative embodiment of the invention.

Referring next to FIG. 4 there is illustrated an alternative embodiment of the invention shown in cross-sectional format. Cylindrical base 32 for contacting the ear has ports 34 and has at least a portion 36 threaded to engage mutually threaded 37 cylindrical earphone support 38 having ports 40. The spacer provided by base 32 and support 38 is thus adjustable in width over the distance defined between stop 42 on base 32 and stop 44 on support 38 by mutually rotating the two cylinders.

As in the previous embodiment, a screen may be attached to the outer end of support 38. As will be apparent this coaxial arrangement may operate with either support 38 inside base 32 as shown or alternatively, with support 38 inside base 32. Further additional intermediate spacers of the same threaded configuration may be added between base 32 and support 38 to increase the spacing distance available.

As will be obvious to those skilled in the art, variations in the above described apparatus may be made within the scope of the invention which is hereby defined by the following claims.

What is claimed is:

1. An adjustable earphone spacer for holding an earphone a selected distance from the ear comprising in combination:

a. A cylindrical base for contacting the head having a plurality of ports to allow the unimpeded transmission of external sound to the ear; and b. A cylindrical earphone support coaxially threadably engageable with said base to vary the distance between the earphone and the ear, said support having a plurality of ports to allow the unimpeded transmission of external sound to the ear.

2. The apparatus of claim 1 further including a screen disposed across the outer end of said support.

3. The apparatus of claim 2 further including means for limiting the extent of coaxial travel between said base and said support.

4. An earphone spacer for holding an earphone a selected distance from the ear comprising in combination:

a. a cylindrical base for contacting the head having a port to admit sound to the ear;

b. headband means for holding said base in contact with the ear;

c. a cylindrical earphone support having a port to allow unimpeded transmission of sound generated by said earphone to the ear; and d. cylindrical spacing means for spacing said support from said base, said spacing means having a plurality of ports covering a substantial area of the surface of said spacing means arranged to allow unimpeded transmission of ambient sound to the ear.

5. The apparatus of claim 4 wherein said spacing means comprises a plurality of said cylinders and further includes detachable holding means for securing said cylinders to said base, said support, and one another.

6. The apparatus of claim 4 further including a screen disposed across the outer end of said earphone support.

* * * * *